US006444928B2

(12) United States Patent
Okamoto et al.

(10) Patent No.: US 6,444,928 B2
(45) Date of Patent: Sep. 3, 2002

(54) MULTIPLE PUSH BUTTON MATRIX SWITCH WITH PERMEABLE FILM FLANGED PORTION AND HERMETIC SEALING

(75) Inventors: Satoshi Okamoto; Toshiya Inubushi, both of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,869

(22) Filed: Apr. 27, 2001

Related U.S. Application Data

(63) Continuation of application No. PCT/JP00/05299, filed on Aug. 7, 2000, now abandoned.

(30) Foreign Application Priority Data

Aug. 27, 1999 (JP) ..... 11-241088

(51) Int. Cl.[7] ..... H01H 13/705

(52) U.S. Cl. ..... 200/5 A; 200/512; 200/302.2; 200/341

(58) Field of Search ..... 200/5 A, 512–517, 200/329–345, 86 R, 5 R, 302.1–302.3

(56) References Cited

U.S. PATENT DOCUMENTS 5,362,934 A * 11/1994 Inagaki et al. ..... 200/302.2
5,475,192 A * 12/1995 Inagaki et al. ..... 200/341

FOREIGN PATENT DOCUMENTS

| | | |
|---|---|---|
| JP | 56-123628 | 9/1981 |
| JP | 8-7698 | 1/1996 |
| JP | 10-162689 | 6/1998 |
| JP | 11-149841 | 6/1999 |

* cited by examiner

*Primary Examiner*—J. R. Scott
(74) *Attorney, Agent, or Firm*—Oblon, Spivak, McClelland, Maier & Neustadt, P.C.

(57) ABSTRACT

A push button switch of the invention has base rubber having actuator portions, a resin molded portion attached to the base rubber, and a permeable film formed on the surface of the resin molded portion. More preferably, a flange portion of the film is disposed so as to avoid a region just above thick portions such as base plate supported portions of the base rubber. A push button switch capable of preventing peeling of coating or the like and intrusion of water can be therefore provided. A push button switch and a switching device which have satisfactory touch and can be thinned can be provided.

8 Claims, 11 Drawing Sheets

MULTIPLE PUSH BUTTON MATRIX SWITCH WITH PERMEABLE FILM FLANGED PORTION AND HERMETIC SEALING

REFERENCE TO RELATED APPLICATION

This Application is a continuation of International Application No. PCT/JP00/05299, whose international filing date is Aug. 7, 2000, which is now abandoned and which was not published in English, which in turn claims the benefit of Japanese Patent Application No. 11-241088, filed Aug. 27, 1999, the disclosure of which Application is incorporated by reference herein. The benefit of the filing and priority dates of the International and Japanese Application is respectfully requested.

BACKGROUND OF THE INVENTION

1. Field of the Invention

The present invention relates to a push button switch and a switching device.

2. Description of the Background Art

FIG. 12 is a schematic cross section showing a first example of a conventional push button switch. Referring to FIG. 12, the push button switch mainly has resin keys 101 and a base rubber 103. The resin keys 101 are made of a resin and adhered to the base rubber 103. The base rubber 103 has base plate supported portions 103*a* and 103*b* which are thick portions and actuator portions 103*c*. The base plate supported portions 103*a* and 103*b* are portions for supporting the base rubber 103 on a base plate 105. The actuator portions 103*c* are portions in each of which a metal plate 104 is pressed to perform switching.

FIG. 13 is a schematic cross section showing a second example of a conventional push button switch. Referring to FIG. 13, the push button switch mainly has base bodies 201 of keys (buttons) and a film 202. The film 202 is formed on the surface of the base bodies 201 and has permeability (translucency) so that the underlayer permeates through the film 202. The base body 201 has an actuator portion 201*a* formed integrally with the base body 201. The actuator portion 201*a* is a portion in which a metal plate 204 on a base plate 205 is pressed to perform switching.

In the push button switch shown in FIG. 12, in the case of making a design on the surface of the resin key 101, printing or coating is performed. There is, however, a problem such that when an operation of depressing the resin key 101 is repeated for switching, the printing or coating is peeled off.

The push button switch shown in FIG. 13 has a problem such that water enters between the base body 201 and the base plate 205 from the outside of the device to thereby short-circuit the switching portion and penetrates to the inner side to short-circuit a motor or the like housed in the device.

It is also necessary to pay attention so that deterioration in the touch at the time of depressing a key for switching is not caused.

SUMMARY OF THE INVENTION

An object of the invention is, therefore, to provide a push button switch and a switching device capable of preventing a design in printing, coating, or the like from being peeled off and preventing intrusion by water.

Another object of the invention is to improve the touch in switching operation.

A push button switch of the present invention is a push button switch for performing a switching operation by pressing a metal plate on a base plate by depression of a button, having: base rubber, a base body of the button, and a film. The base rubber is disposed on the base plate and has an actuator portion capable of pressing the metal plate. The base body of the button is attached to the base rubber. The film is formed on the surface of the base body and has permeability.

In the push button switch of the invention, a permeable film is formed on the base body of the button. The film is made of a material having wear resistance higher than that of printing or coating. Consequently, the peeling due to wear of the film at the time of the switching operation can be prevented.

Since the film has permeability, the design on the underlayer can permeate the film and is displayed. By coloring the film, the degree of freedom in designing can be increased.

The base rubber is prepared by using a material different from the material of the base body of the button. By the base rubber, intrusion of water into a region between the base plate and the base rubber can be prevented. Thus, a short circuit in a switching portion and a short circuit in a motor can be prevented.

In the push button switch, preferably, the base rubber has thick base plate supported portion on the surface of the base plate. The film has a flange portion extending from a side portion of the base body to an outer periphery side so as to have a gap between the flange portion and the surface of the base rubber. The flange portion is disposed so as to avoid a region just above the base plate supported portion.

As described above, since there is a gap between the flange portion of the film and the surface of the base rubber, the operation load can be lessened without disturbing the depression deformation of the base rubber by the flange portion at the time of the button depressing operation. Specifically, when the flange portion of the film is adhered to the surface of the base rubber, the adhered portion disturbs the deformation in the base rubber at the time of the depressing operation, so that the operation load increases. There is no such increase in operation load.

Since the flange portion is disposed so as to avoid a region just above the base plate supported portions, the flange portion does not interfere with the upper ends of the base plate supported portions at the time of the button depression operation, so that the operation load can be lessened. That is, when the flange portion is disposed in the region just above the base plate supported portion, the flange portion interferes with the upper ends of the base plate supported portion at the time of the depressing operation and the operation load increases. There is no such increase in operation load.

Since the flange does not interfere with the upper ends of the base plate supported portion, the space between the flange portion and the base rubber can be reduced to be smaller than the operation stroke, and it becomes easy to reduce the thickness of the device body.

Preferably, in the push button switch, a space between the flange portion and the surface of the base rubber is smaller than a stroke of a switching operation of the metal plate.

As described above, the flange portion can be prevented from interfering with the base plate supported portion. The space between the flange portion and the surface of the base rubber can be made smaller than the stroke for the switching operation. Thus, the device body can be thinned.

The stroke of the switching operation of the metal plate in the application denotes a depression displacement amount until the switching is completed.

In the push button switch, preferably, the base plate supported portion have an outer peripheral portion disposed around the entire periphery of the base rubber, and the outer peripheral portion has a construction of preventing intrusion of water into a region surrounded by the base rubber and the surface of the base plate by being closely attached to the surface of the base plate.

The intrusion of water into a space surrounded by the base rubber and the base plate can be therefore prevented, so that a short circuit in the switching portion and a short circuit in the motor can be prevented.

A switching device according to one aspect of the invention has a base plate, base rubber, a plurality of base bodies of buttons, and a permeable film. On the base plate, a plurality of metal plates which are switched by being pressed are arranged. The base rubber covers the plurality of metal plates arranged, has thick base plate supported portions closely attached onto the base plate at the entire periphery, and has actuator portions in facing portions on the metal plates. The plurality of base bodies of buttons are attached to positions corresponding to the actuator portions on the base rubber. The permeable film is formed on the surface of the base body and has a flange portion extending from a side portion of the base body to the outer peripheral side.

A switching device according to another aspect of the invention has a base plate, base rubber, a plurality of base bodies of buttons, and a permeable film. On the base plate, a plurality of metal plates switched by being pressed by actuator portions are arranged. The base rubber covers the plurality of metal plates arranged and has thick base plate supported portions closely attached onto the base plate at the entire periphery. The plurality of base bodies of buttons are disposed on the base rubber and are pressed integrally with the actuator portions. The permeable film is formed on the surface of the base body and has a flange portion extending from a side portion of the base body to the outer peripheral side.

In the switching devices according to one and another aspects of the invention, a permeable film is formed on the base body of a button. The film is made of a material having wear resistance higher than that of printing or coating. Consequently, the peeling due to wear of the film at the time of the switching operation can be prevented.

Since the film has permeability, the design on the underlayer can permeate the film and is displayed. By coloring the film, the degree of freedom in designing can be increased.

The base rubber is prepared by using a material different from the material of the base body of the button. By the base rubber, intrusion of water into a region between the base plate and the base rubber can be prevented. Thus, a short circuit in a switching portion and a short circuit in a motor can be prevented.

In the switching devices according to one and another aspects, preferably, a gap is formed between the flange portion and the surface of the base rubber.

As there is a gap between the flange portion of the film and the surface of the base rubber, the operation load can be lessened without disturbing the depression deformation of the base rubber by the flange portion at the time of the switching. Specifically, when the flange portion of the film is adhered to the surface of the base rubber, the adhered portion disturbs the deformation in the base rubber at the time of the depressing operation. There is no such increase in operation load.

In the switching devices according to one and another aspects, preferably, a gap is formed between the flange portion and the base plate supported portion.

Since there is a gap between the flange portion and the base plate supported portions, interference of the flange portion with the upper ends of the base plate supported portions at the time of switching is suppressed, so that the operation load can be lessened. Specifically, when the flange portion is adhered to the base plate supported portion, the flange portion is pulled by the base plate supported portion at the time of switching and the operation load increases. There is no such increase in operation load.

Since there is a gap between the flange portion and the base plate supported portion, the space between the flange portion and the base rubber can be reduced so as to be smaller than the operation stroke, so that the thickness of the device body can be easily reduced.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will be described hereinbelow with reference to the drawings.

First Embodiment

Figure 1:
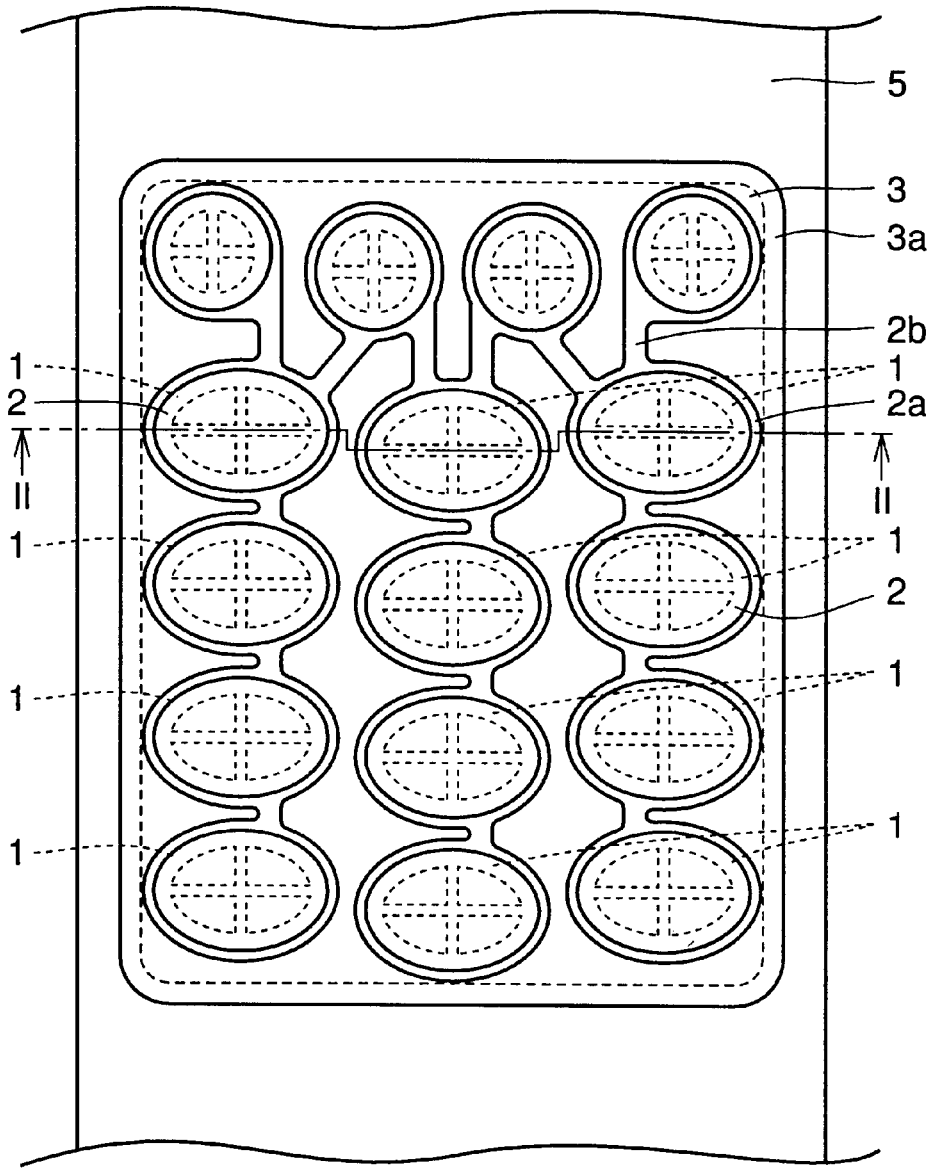
FIG. 1 is a plan view schematically showing the construction of a push button switch in a first embodiment of the invention.
Figure 2:
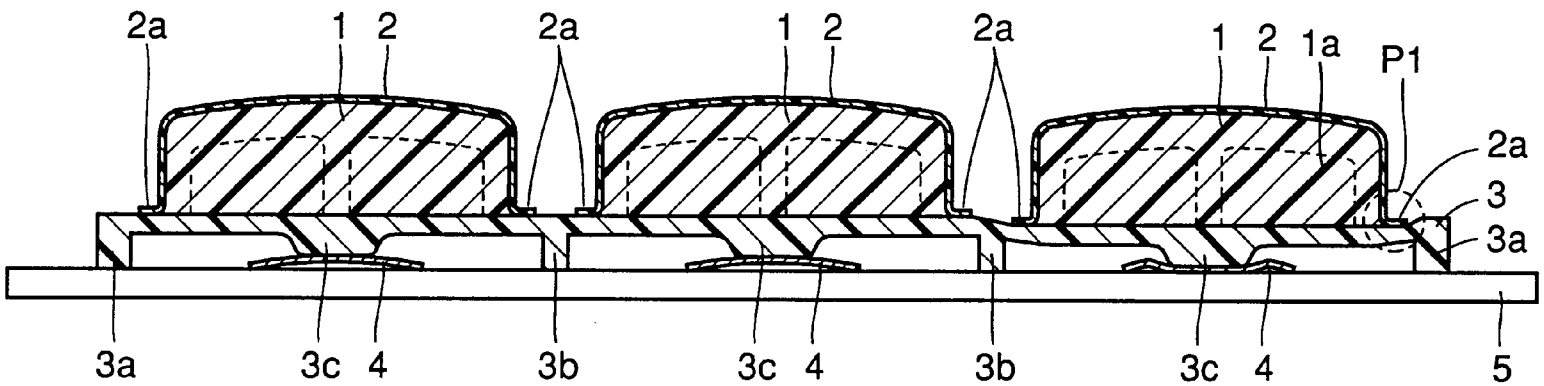
FIG. 2 is a schematic cross section taken along the line II—II of FIG. 1.

FIG. 1 is a plan view schematically showing the construction of a push button switch in a first embodiment of the invention. FIG. 2 is a schematic cross section taken along the line II—II of FIG. 1.

Referring to FIGS. 1 and 2, a push button switch of the embodiment mainly has resin molded portions 1, a film 2, and base rubber 3. The resin molded portion 1 is a base body of a key (button) and is formed by injection-molding a resin. On the surface of the resin molded portion 1, the film 2 having permeability (translucency) through which an underlayer permeates is formed.

The film 2 is made of a moldable material such as a resin which is, for example, a high molecular compound such as PET (polyethylene trephthalate), PC (polycarbonate), or urethane or a composite of those compounds. The film 2 has a flange portion 2*a* extending from a side portion of the resin molded portion 1 to the peripheral side. The flange portion 2*a* is formed due to limitation in processing of the film 2. The resin molded portion 1 and the flange portion 2*a* are adhered to the surface of the base rubber 3 via an adhesive layer (not shown) or the like.

The base rubber 3 is, for example, silicon rubber and has base plate supported portions 3*a* and 3*b* which are thick portions and actuator portions 3*c*. The actuator portion 3*c* is a portion in which a dome-shaped metal plate 4 is pressed, thereby performing switching. Especially, the base plate supported portion 3*a* is disposed so as to surround the entire outer periphery of the base rubber 3 as shown in FIG. 1.

The resin molded portion 1 has a hollow 1*a*, thereby reducing the weight. The resin molded portion 1 does not always have to have the hollow portion 1*a* but may have a solid structure.

The film 2 has a key bridge portion 2*b* for connecting the keys as shown in FIG. 1. By connecting the films of the keys by the key bridge portions 2*b*, the film of only one key can be prevented from peeling off from the resin molded portion 1 and only the character of one key can be prevented from being inverted.

In the push button switch of the embodiment, the film 2 is made of a material having wear resistance higher than that of printing and coating. Consequently, the film 2 can be prevented from being peeled off due to wear in the switching operation.

Since the film 1 has the permeability, a design on the underlayer can permeate the film 1 and is displayed. By coloring the film 2, the degree of freedom in designing can be increased.

The base rubber 3 has, as shown in FIG. 1, the base plate supported portion 3*a* which is a thick portion around the entire outer periphery. The base plate supported portion 3*a* is closely attached to the surface of a base plate 5 as shown in FIG. 2, thereby preventing intrusion of water into a region surrounded by the base plate 5 and the base rubber 3. Consequently, a short circuit in the switching portion caused by water can be prevented, and a short circuit in a motor or the like housed in the device can be also prevented.

Second Embodiment

In the first embodiment, the flange portion 2*a* is adhered to the base rubber 3 in a portion P1 in FIG. 2. Consequently, at the time of a key depressing operation for switching, a depression deformation of the base rubber 3 is disturbed by the flange portion 2*a* in the adhered portion. The operation load therefore increases and, further, a reduction in the click rate occurs, so that it is difficult to obtain more satisfactory touch.

The embodiment aims at obtaining the more satisfactory touch than in the first embodiment.

Figure 3:
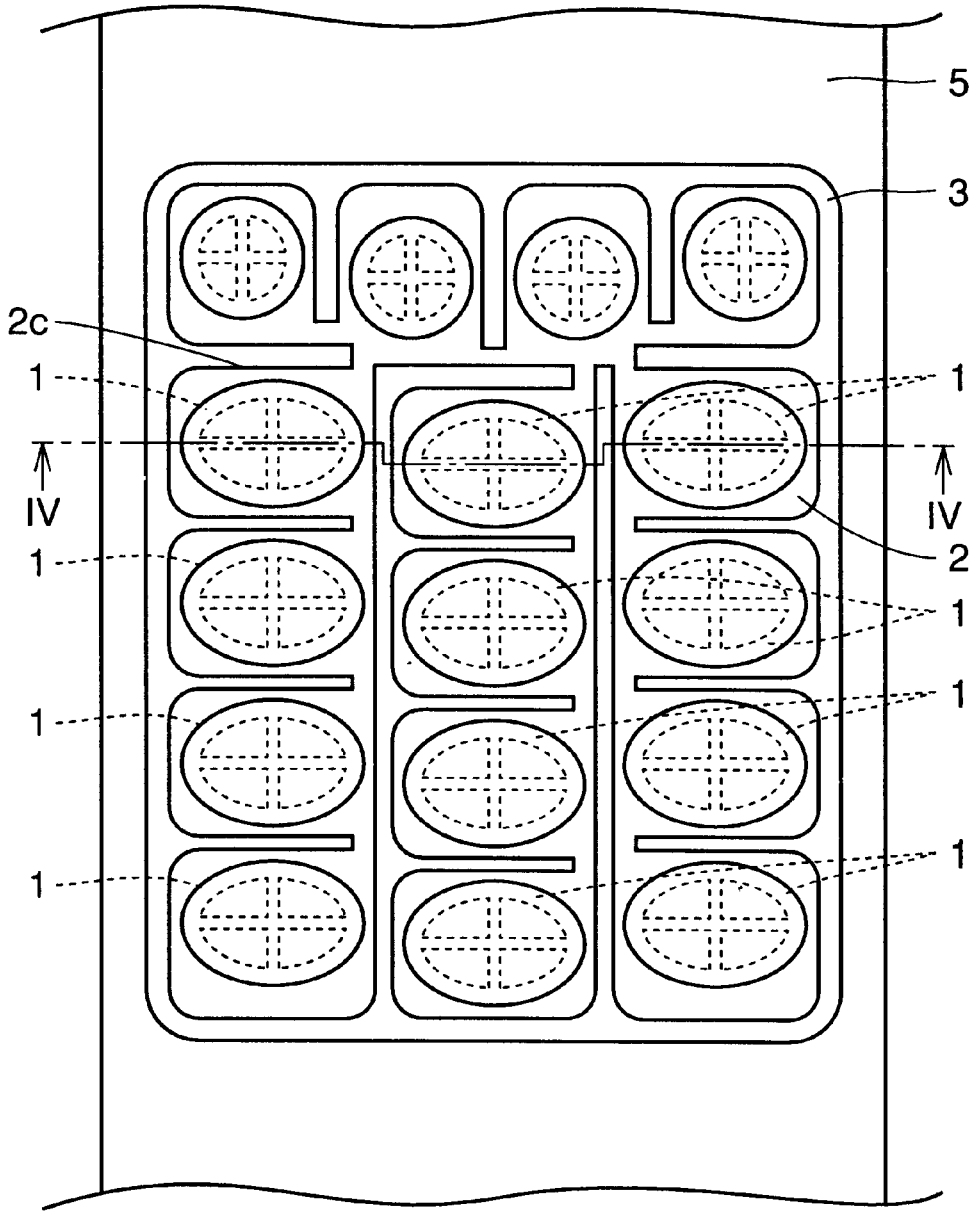
FIG. 3 is a plan view schematically showing the construction of a push button switch in a second embodiment of the invention.
Figure 4:
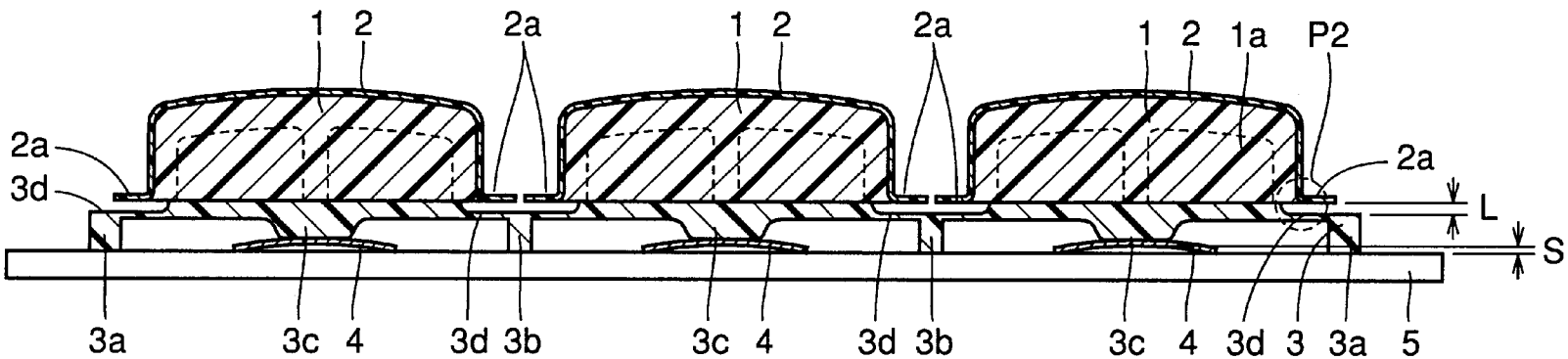
FIG. 4 is a schematic cross section taken along the line IV—IV of FIG. 3.

FIG. 3 is a plan view schematically showing the construction of a push button switch in the second embodiment of the invention. FIG. 4 is a schematic cross section taken along the line IV—IV of FIG. 3.

Referring to FIGS. 3 and 4, the push button switch of the embodiment is different from that of the first embodiment with respect to a point that a recess 3*d* is formed in the base rubber 3. By the recess 3*d*, a gap is formed between the base rubber 3 and the flange portion 2*a* of the film 2.

Since the other construction is substantially the same as that of the first embodiment, the same components are designated by the same reference numerals and their description is omitted.

In the embodiment, as shown in a portion P2 in FIG. 4, the flange portion 2*a* of the film 2 and the surface of the base rubber 3 are apart from each other with a gap and are not adhered to each other. Consequently, the flange portion 2*a* does not disturb the deformation in the base rubber 3 by the depression in the key depressing operation for switching. It does not therefore cause an increase in load and a reduction in the click rate, so that more satisfactory touch can be obtained.

Third Embodiment

The second embodiment has the construction that the film 2 has a slit 2*c* as shown in FIG. 3. Consequently, the flange portion 2*a* of the film 2 extends also in a region just above the base plate supported portions 3*a* and 3*b* of the base rubber 3 as shown in FIGS. 4 and 5.

Figure 5:
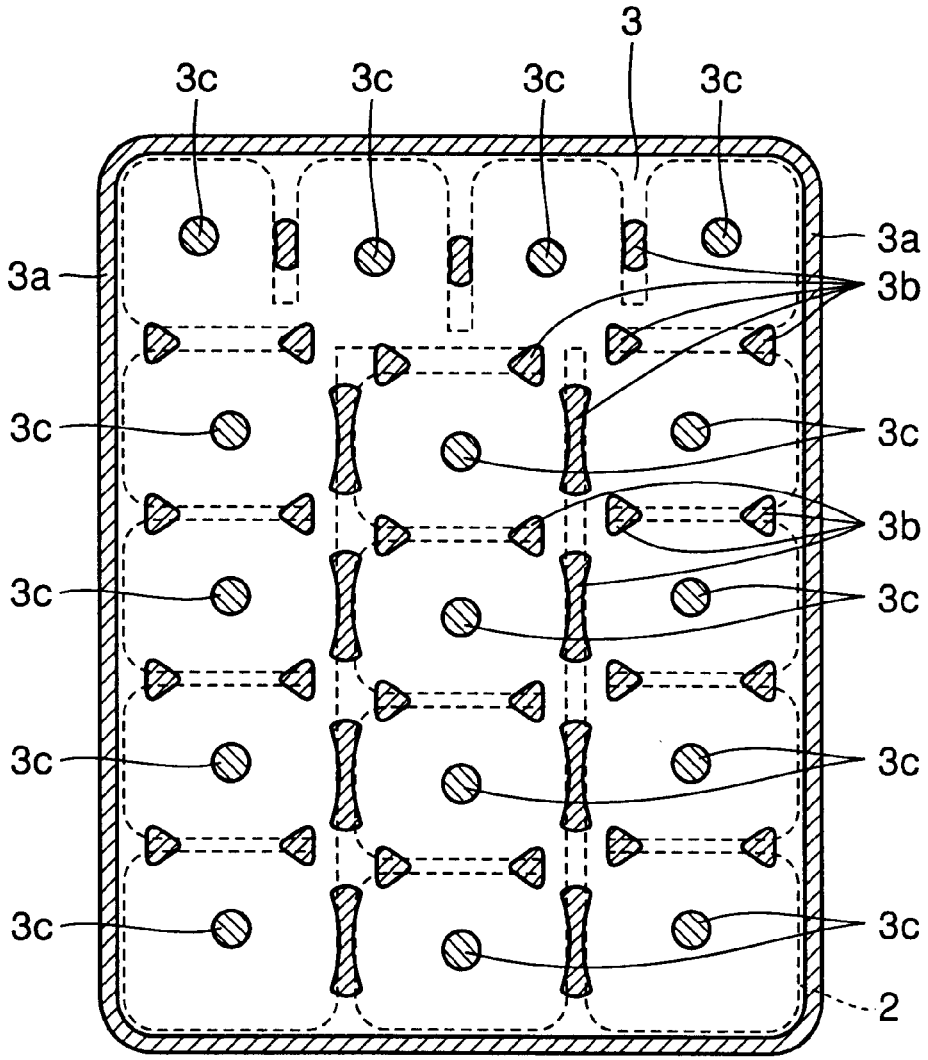
FIG. 5 is a diagram showing a relative positional relation between a thick portion in base rubber and a film in the push button switch in the second embodiment of the invention.

FIG. 5 is a diagram in which thick portions such as the base plate supported portions 3*a* and 3*b* of the base rubber 3 and the actuators 3*c* are hatched and the film 2 is illustrated by dotted lines.

Figure 6:
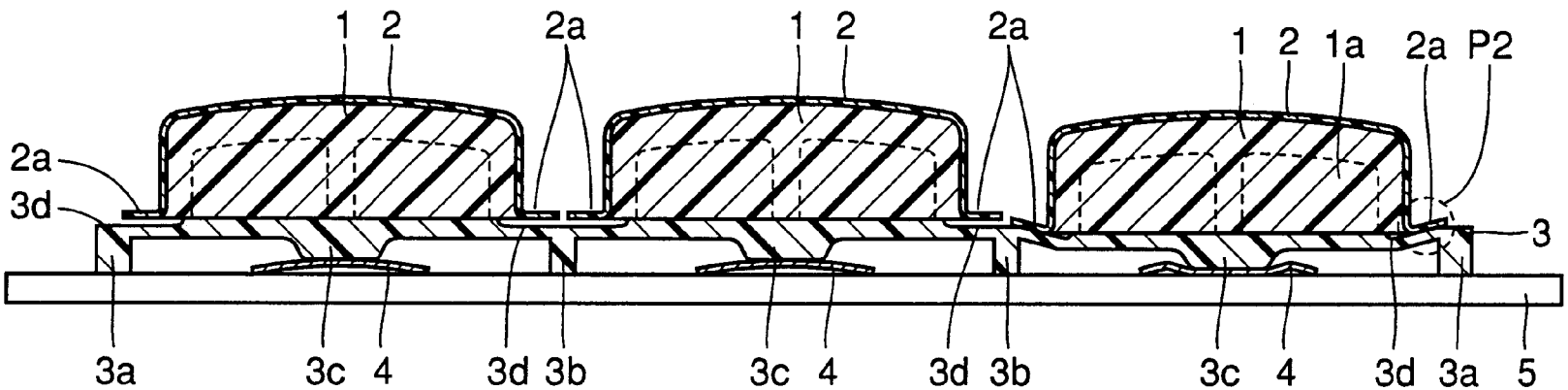
FIG. 6 is a diagram showing a state where a flange portion interferes with the upper end of the base rubber in the push button switch in the second embodiment of the invention.

In the second embodiment, therefore, in the case where a space L between the base rubber 3 and the flange portion 2*a* is smaller than an operation stroke S of the metal plate 4 in FIG. 4, the flange portion 2*a* interferes with the upper ends of the base plate supported portions 3*a* and 3*b* as shown in a portion P2 in FIG. 6. As a result, the operation load increases and a reduction in the click rate occurs, so that it becomes difficult to obtain more satisfactory touch.

In order to prevent the interference between the flange portion 2*a* and the base plate supported portions 3*a* and 3*b*, there is a method of setting the space L shown in FIG. 4 to be larger than the operation stroke S. It is, however, difficult to make the base rubber 3 below the recess 3*d* thinner (that is, it is difficult to form the recess 3*d* more deeply because the thickness of the base rubber 3 below the recess 3*d* has been already reduced for lighter weight. Consequently, in order to increase the space L between the flange portion 2*a* and the surface of the base rubber 3, the resin molded portion 1 has to be disposed in a position higher with respect to the base plate 5. In this case, however, it becomes difficult to thin the device body.

The embodiment aims at obtaining the touch more satisfactorily than the second embodiment and at further reducing the thickness of the device body.

The operation stroke S in the application denotes a depression displacement amount of a key when the switching is completed. More specifically, the operation stroke S almost coincides with the space between the under face of the dome-shaped metal plate 4 in FIG. 4 and the surface of a connected portion (not shown) on the base plate 5.

Figure 7:
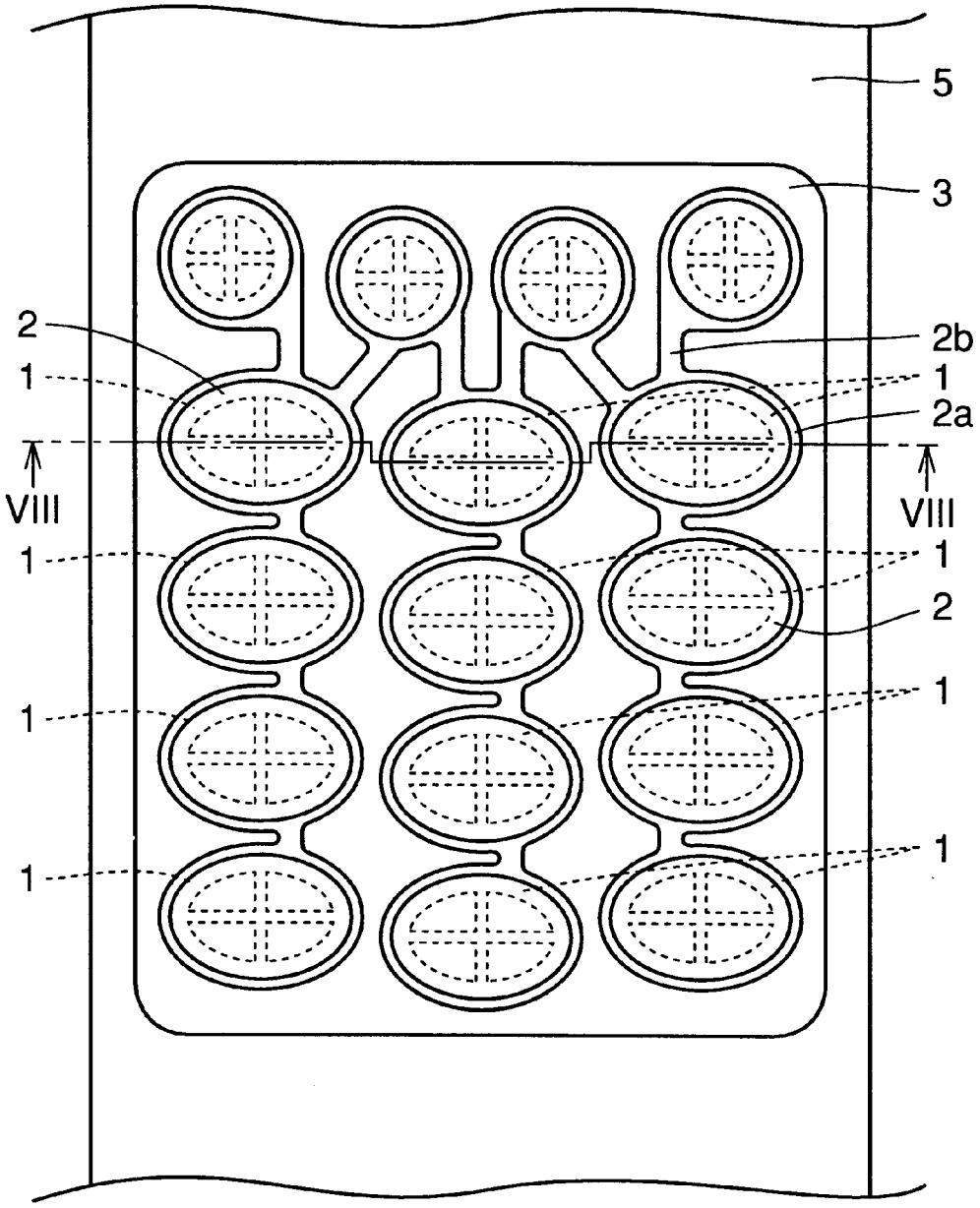
FIG. 7 is a plan view schematically showing the construction of a push button switch in a third embodiment of the invention.
Figure 8:
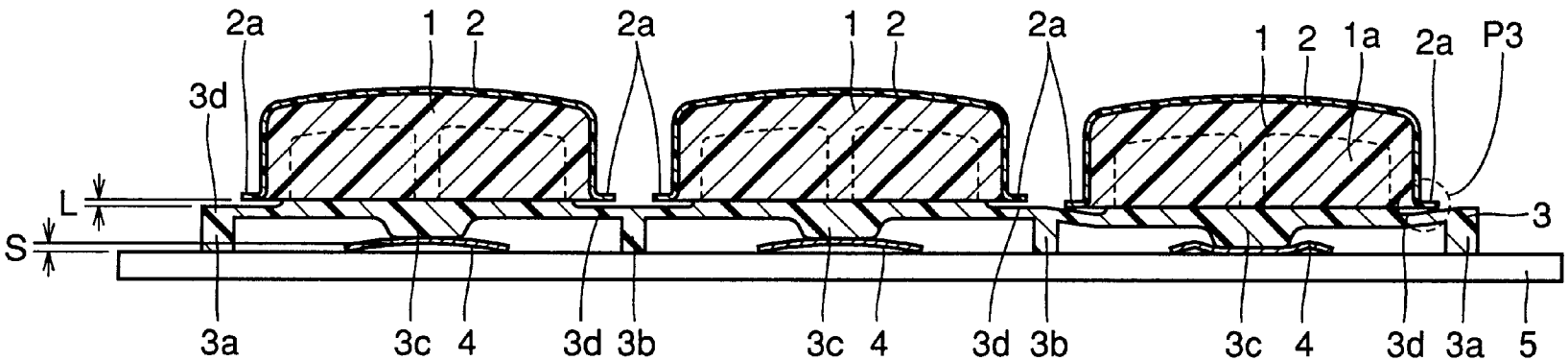
FIG. 8 is a schematic cross section taken along the line VIII—VIII of FIG. 7.
Figure 9:
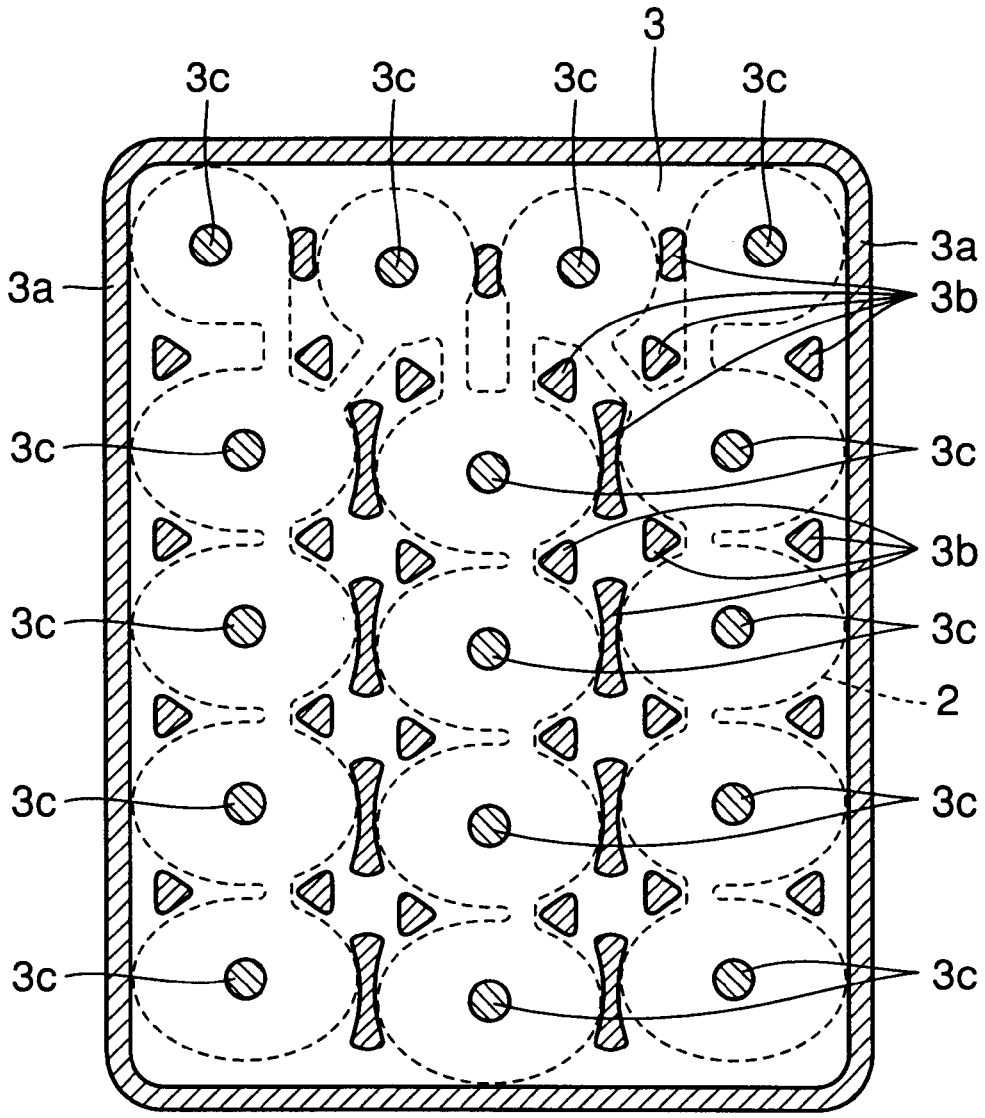
FIG. 9 is a diagram showing a relative positional relation between a thick portion in base rubber and a film in the push button switch in the third embodiment of the invention.

FIG. 7 is a plan view schematically showing the construction of a push button switch in a third embodiment of the invention. FIG. 8 is a schematic cross section taken along the line VIII—VIII of FIG. 7.

Referring to FIGS. 7 and 8, the push button switch of the embodiment is different from the construction of the second embodiment with respect to the shape of the film 2. The film 2 has the flange portions 2*a* extending from a side portion of the resin molded portion 1 to the outer peripheral side and key bridge portions 2*b* connecting key portions. The flange portion 2*a* and the key bridge portion 2*b* are disposed so as to avoid a region just above the base plate supported portions 3*a* and 3*b*.

Since the other construction is substantially the same as that of the second embodiment, the same components are designated by the same reference numerals and their description is omitted.

In the embodiment, the flange portion 2*a* and the key bridge portion 2*b* are disposed so as to avoid a region just above the base plate supported portions 3*a* and 3*b*. Consequently, at the time of a key depressing operation, as shown by a portion P3 in FIG. 8, the flange portion 2*a* and the key bridge portion 2*b* can be prevented from interfering with the upper ends of the base plate supported portions 3*a* and 3*b*. There is consequently no deterioration in the touch caused by the interference, and more satisfactory touch can be obtained. The space L between the flange portion 2*a* and the surface of the base rubber 3 can be made smaller than the operation stroke S, so that the device body can be further thinned.

The click rates of the push button switches of the first to third embodiments will now be compared with each other.

Figure 10:
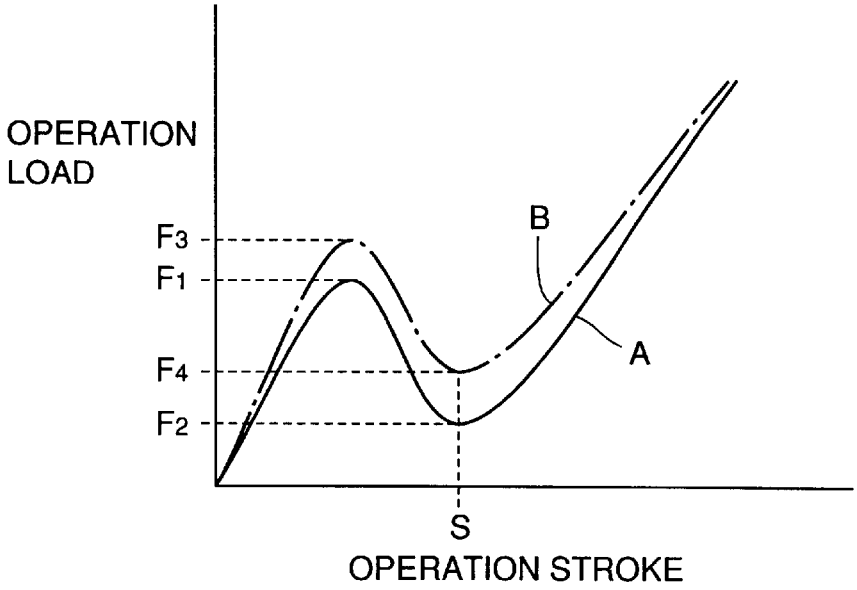
FIG. 10 is a diagram showing the relation between an operation stroke and an operation load.

When the displacement amount of a key in the depression direction at the time of the key depressing operation is set as an operation stroke and a force applied on the key at that time is set as an operation load, the relation between the operation stroke and the operation load is as shown by, for example, a curve indicated by a solid line A in FIG. 10. Specifically, the operation load increases to a predetermined operation stroke. After the operation load reaches a load $F_1$, the operation load decreases until it reaches the operation stroke S (FIG. 8). The operation load suddenly increases after the operation stroke S.

The click rate is given here by the following equation.

$$\text{click rate} = \frac{F_{\max} - F_a}{F_{\max}} \times 100\,(\%)$$

Fmax in the equation denotes the maximum value of the operation load in the range to the operation stroke S and corresponds to $F_1$ in the solid line A. Fa indicates an operation load at the operation stroke S and corresponds to $F_2$ in the solid line A.

It is said that the person who performs a switching operation cannot feel comfortable touch at a low click rate.

Assuming now that the solid line A in FIG. 10 corresponds to the third embodiment of the invention, a curve shown by an alternate long and short dash line B corresponds to, for example, the first embodiment of the invention for the following reason. In the first embodiment, the adhered portion between the flange portion 2*a* and the base rubber 3 always functions as a resistance at the time of the depressing operation as shown in FIG. 2 and the operation load increases by the amount corresponding to the resistance. In this case, in the third embodiment (solid line A), (Fmax−Fa) is large and Fmax is small as compared with the first embodiment (alternate long and short dash line B). It is consequently understood that the click rate is high and the touch is satisfactory.

Figure 11:
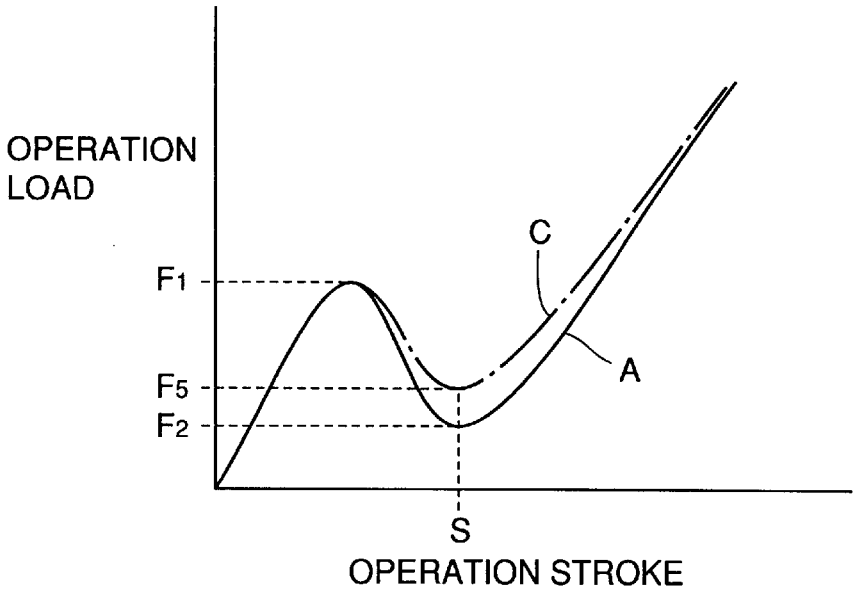
FIG. 11 is a diagram showing the relation between an operation stroke and an operation load.
Figure 12:
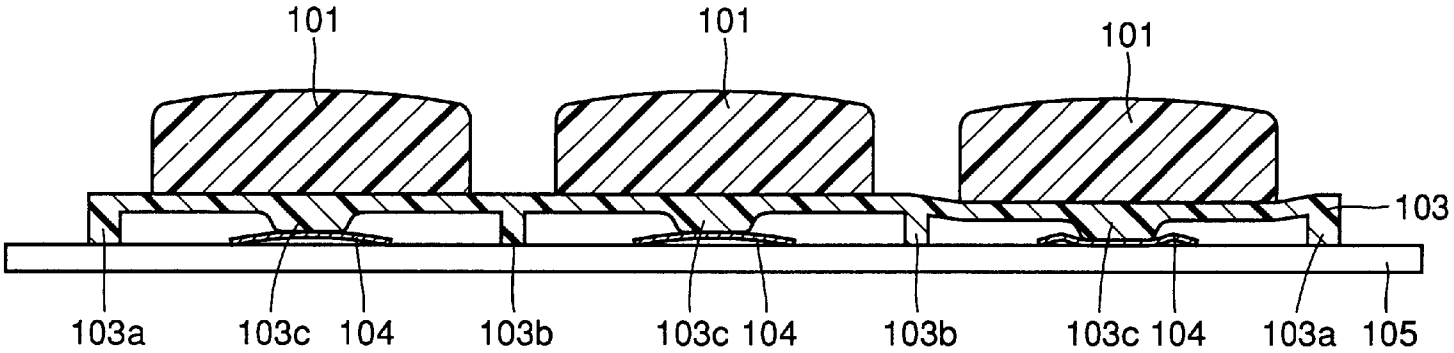
FIG. 12 PRIOR ART
FIG. 12 is a schematic cross section showing a first example of a conventional push button switch.
Figure 13:
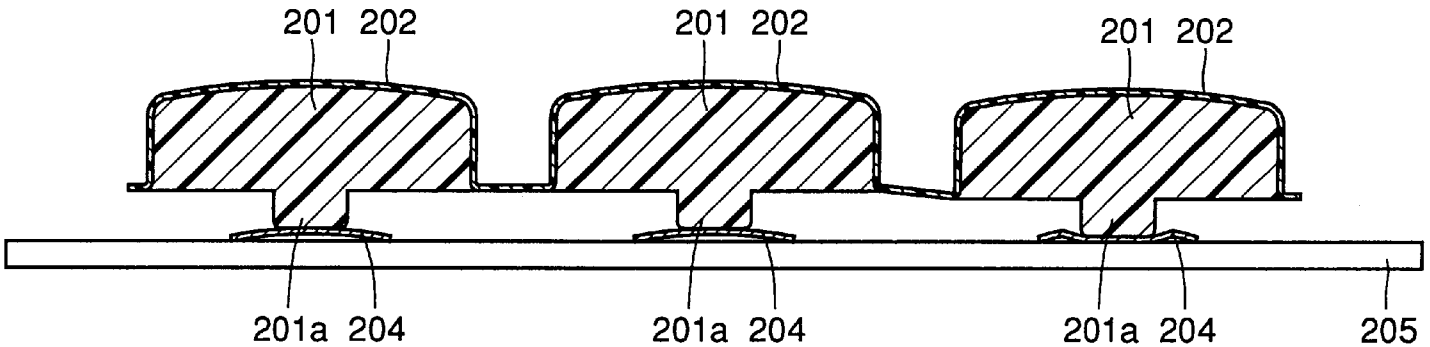
FIG. 13 PRIOR ART
FIG. 13 is a schematic cross section showing a second example of a conventional push button switch.

Referring now to FIG. 11, when it is assumed that the solid line A corresponds to the third embodiment of the invention, the curve shown by an alternate long and short dash line C corresponds to, for example, the second embodiment of the invention for the following reason. In the second embodiment, the flange portion 2*a* interferes with the base rubber 3 when a key is depressed by a predetermined amount as shown in FIG. 6, the interfered portion acts as a resistance of the depressing operation, and the operation load increases by the amount corresponding to the resistance. In this case, in the third embodiment (solid line A), (Fmax−Fa) is larger than that in the second embodiment (alternate long and short dash line C). Consequently, it is understood that the click rate is higher and the touch is more satisfactory.

It is understood from the above that, in the third embodiment, the click rate is higher than that in any of the first and second embodiments and more satisfactory touch is obtained.

Although the push button switches have been described in the first to third embodiments, the invention is not limited to push button switches but can be applied to any switching devices for performing a switching operation by being pressed.

It should be understood that the embodiments disclosed this time are illustrative and not restrictive in every aspect. The scope of the invention is defined by the appended claims rather than by the above description, and meaning equivalent to the claims and all changes that fall within the claims are therefore intended to be included.

The present invention can be advantageously applied to a push button switch and a switching device capable of preventing a design in printing, coating, or the like from being peeled off and preventing intrusion of water and, further, can improving the touch at the time of a switching operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A switching device for a switching operation, comprising:

a base plate on which a plurality of metal plates are positioned to be pressed such that said plurality of metal plates are electrically connected to a plurality of connection portions, respectively;

a base rubber provided over said plurality of metal plates and having an outer base plate supported portion and a plurality of inner base plate supported portions adhered to said base plate such that said plurality of metal plates are encased by said outer base plate portion and surrounded individually by respective ones of said plurality of base plate supported portions, said base rubber having a plurality of actuator portions positioned to press said plurality of metal plates, respectively;

a plurality of button base bodies provided on said base rubber and positioned to be pressed integrally with said plurality of actuator portions, respectively; and a plurality of permeable films provided over said plurality of button base bodies, respectively, and each having a flange portion surrounding a respective one of the plurality of button base bodies;

wherein said outer base plate supported portion and inner base plate supported portions are not positioned directly below the flange portions.

2. The switching device according to claim 1, wherein:

the plurality of permeable films are connected each other via a plurality of key bridge portions integrally connecting the flange portions; and said plurality of key bridge portions are not provided above said outer base plate supported portion and inner base plate supported portions.

3. A switching device for switching operation, comprising:

a base plate on which a plurality of metal plates are positioned to be pressed such that said plurality of metal plates are electrically connected to a plurality of connection portions, respectively;

a base rubber provided over said plurality of metal plates and having an outer base plate supported portion and a plurality of inner base plate supported portions adhered to said base plate such that said plurality of metal plates are encased by said outer base plate portion and surrounded individually by respective ones of said plurality of base plate supported portions;

a plurality of actuators positioned to press said plurality of metal plates, respectively;

a plurality of button base bodies provided on said base rubber and positioned to be pressed integrally with said plurality of actuators, respectively; and a plurality of pemeable films is provided over said plurality of button base bodies, respectively and each having a flange portion surrounding a respective one of the plurality of button base bodies;

wherein said outer base plate supported portion and inner base plate supported portions are not positioned directly below the flange portions.

4. The switching device according to claim 3, wherein:

the plurality of permeable films are connected each other via a plurality of key bridge portions integrally connecting the flange portions; and said plurality of key bridge portions are not provided above said outer base plate supported portion and inner base plate supported portions.

5. A switching device comprising:

a base plate on which a plurality of said metal plates are positioned to be pressed such said plurality of metal plates are electrically connected to a plurality of connected portions, respectively;

a base rubber provided over said plurality of metal plates and having an outer base plate supported portion and a plurality of inner base plate portions adhered to said base plate such that said plurality of metal plates are encased by said outer base plate portion and surrounded individually by respective ones of said plurality of base plate supported portions, said base rubber having a plurality of actuator portions positioned to press said plurality of metal plates, respectively;

a plurality of button base bodies provided on said base rubber and positioned to be pressed integrally with said plurality of actuator portions, respectively; and a plurality of permeable films provided over said plurality of button base bodies, respectively, and each having a flange portion surrounding a respective one of the plurality of button base bodies, the flange portions being positioned above an upper surface of said base rubber such that the upper surface of said rubber and the flange portions form a gap larger than an operation stroke of said plurality of actuator portions.

6. The switching device according to claim 5, wherein:

the plurality of permeable films are connected each other via a plurality of key bridge portions integrally connecting the flange portions; and said plurality of key bridge portions are not provided above said outer base plate supported portion and inner base plate supported portions.

7. A switching device, comprising:

a base plate on which a plurality of metal plates are positioned to be pressed such that said plurality of metal plates are electrically connected to a plurality of connection portions, respectively;

a base rubber provided over said plurality of metal plates and having an outer base plate supported portion and a plurality of inner base plate supported portions adhered to said base plate such that said plurality of metal plates are encased by said outer base plate portion and surrounded individually by respective ones of said plurality of base plate supported portions;

a plurality of actuators positioned to press said plurality of metal plates, respectively;

a plurality of button base bodies provided on said base rubber and positioned to be pressed integrally with said plurality of actuators, respectively; and a plurality of permeable films is provided over said plurality of button base bodies, respectively, and each having a flange portion surrounding a respective one of the plurality of button base bodies, the flange portions being positoned above an upper surface of said base rubber such that the upper surface of said base rubber and the flange portions form a gap larger than an operation stroke of said plurality of actuator portions.

8. The switching device according to claim 7, wherein:

the plurality of permeable films are connected each other via a plurality of key bridge portions integrally connecting the flange portions; and said plurality of key bridge portions are not provided above said outer base plate supported portion and inner base plate supported portions.

* * * * *